US008925547B2

(12) United States Patent
Latshaw

(10) Patent No.: US 8,925,547 B2
(45) Date of Patent: Jan. 6, 2015

(54) VENTILATION VALVE FOR AN ANESTHESIA SYSTEM

(76) Inventor: Harry Latshaw, Rossville, IN (US)

( * ) Notice: Subject to any disclaimer, the term of this patent is extended or adjusted under 35 U.S.C. 154(b) by 476 days.

(21) Appl. No.: 13/065,538

(22) Filed: Mar. 24, 2011

(65) Prior Publication Data

US 2011/0232639 A1 Sep. 29, 2011

Related U.S. Application Data

(60) Provisional application No. 61/340,930, filed on Mar. 24, 2010.

(51) Int. Cl.
*A62B 9/02* (2006.01)
*A61M 16/00* (2006.01)
*A61D 7/04* (2006.01)

(52) U.S. Cl.
CPC ..... *A61D 7/04* (2013.01)
USPC ..... 128/205.24; 128/205.13

(58) Field of Classification Search
CPC ... A61M 16/20; A61M 16/208; A61M 16/00; B63C 11/2227; A62B 9/02
USPC ..... 128/200.11–200.24, 203.12, 203.15, 128/203.25, 205.13–205.17, 205.24
See application file for complete search history.

(56) References Cited

U.S. PATENT DOCUMENTS

| | | | | | |
|---|---|---|---|---|---|
| 71,934 | A * | 12/1867 | Wilson | 128/207.16 |
| 3,017,881 | A * | 1/1962 | Smith | 128/205.13 |
| 3,700,000 | A * | 10/1972 | Hesse et al. | 137/494 |
| 3,721,239 | A * | 3/1973 | Myers | 128/205.17 |
| 4,108,172 | A * | 8/1978 | Moore, Jr. | 128/205.12 |
| 4,676,239 | A * | 6/1987 | Humphrey | 128/205.17 |
| 4,771,770 | A * | 9/1988 | Artemenko et al. | 128/201.13 |
| 5,404,873 | A | 4/1995 | Leagre et al. | |
| 6,718,978 | B2 * | 4/2004 | Emtell | 128/204.28 |
| 2008/0276937 | A1 * | 11/2008 | Davidson et al. | 128/204.18 |

* cited by examiner

*Primary Examiner* — Melanie Hand
*Assistant Examiner* — Ned T Heffner
(74) *Attorney, Agent, or Firm* — E. Victor Indiano; Indiano Law Group LLC

(57) ABSTRACT

A valve is provided for controlling the flow of gas through an anesthesia or respiratory breathing circuit. The valve includes a valve body having a first port, a second port, and a third port. The third port includes a flow restrictor for restricting the flow of gas through the third port. A valve closing member is provided that is moveable between an open position where gas can flow through the third port, and a closed position. In the closed position, gas is prevented from flowing through the third port.

20 Claims, 4 Drawing Sheets

VENTILATION VALVE FOR AN ANESTHESIA SYSTEM

I. REFERENCE TO RELATED PATENT APPLICATION

This U.S. Non Provisional patent application claims the benefit of and/or priority to Latshaw, U.S. provisional patent application Ser. No. 61/340,930 filed Mar. 24, 2011 entitled "Ventilation Valve for a Veterinary Anesthesia System", the entire content of which is specifically incorporated herein by reference.

II. TECHNICAL FIELD OF THE INVENTION

The present invention relates to veterinary medical devices, and more particularly to a valve useable with an anesthesia system for veterinary purposes, and the anesthesia system including such a valve.

III. BACKGROUND OF THE INVENTION

Anesthesia systems have long been in use on both animals and human beings in order to sedate the patient prior to surgical operations. The administration of anesthetics during surgery reduces or eliminates and provides the physician with a more cooperative patient. The anesthesia art is probably more highly developed with human beings, as humans have been undergoing larger numbers of anesthesia including surgeries than animals. However, much of the equipment and many of the drugs utilized by veterinary anesthetists are similar or identical to that which is used on humans.

Currently, a wide variety of anesthesia circuits are used, along with a variety of components for such anesthesia systems. Human anesthesia system components including breathing circuits, circuitry valves, tubes, masks, tracheal tubes, and ventilation tubes are available from companies such as Vital Signs, King Systems Corporation and others.

In addition to anesthesia devices being used on humans, they are also used on pets, livestock, and other animals. Although the human and animal anesthesia systems bear many similarities, differences also exist because of the differences in the anatomy and physiology of animals, and other factors that one must consider when dealing with animals, that may not be present when dealing with humans. Additionally, in the veterinary field, cost is a much greater consideration, so a higher premium is placed on providing reusable devices, and devices that can be manufactured inexpensively.

Different types of anesthesia systems are available. A choice of which particular anesthesia system to employ for a particular procedure is a function not only of the Veterinarian's preference, but also a function of animal size. It has been found by the Applicant that smaller animals, (i.e. such as those weighing 15 pounds or less) such as cats, small dogs, birds, reptiles, rabbits, guinea pigs and other creatures require the use of an anesthesia device that is different from the anesthesia system that one might use on larger animals, (e.g. over 15 pounds), such as larger dogs, Great Danes, German Shepards, as well as larger farm animals such as horses, cows, sheep, pigs and the like. With larger animals, it is very common to use a rebreathing circuit, similar to rebreathing circuits manufactured for humans. Examples of rebreathing circuits are shown in Leagre and Burrow, U.S. Pat. No. 5,404,823; Burrow et al U.S. Pat. No. 7,175,525; and Fukunaga et U.S. Pat. Nos. 7,418,965, 4,265,235, 6,003,511 and others. However, with smaller animals, a rebreathing circuit is often not used. Rather, with smaller animals, a modified type of Mapleson circuit has been found to be more advantageous to use than rebreathing circuits. Information about Mapleson circuits can be found at Shankar and Kodali, *Anaesthesia Breathing Circuits*, which is available at http://web.archive.org/web/20040714085945/http://www.capnography-.com/Circuits/breathingcircuits.htm (Jun. 14, 2004)

In a Mapleson type circuit, one usually has a small gas source tube that is fed to a fitting that is disposed adjacent to the face of the patient, (here an animal patient). Through this inflow tube flows a mixture of anesthesia gas and oxygen and/or air that is fed directly to the animal.

The downstream end of the gas source tube connects to a "distal end" fitting which is also known as the patient end, since the fitting is disposed adjacent to the patient. A tracheal tube or patient mask can be coupled to the fitting, for delivering the gas from the distal end of the gas source tube to the patient.

Additionally, the fitting includes a port, to which is coupled the distal (or patient) end of an expiratory tube. Gas that is exhaled by the animal patient flows through the expiratory tube, and is ultimately discharged to atmosphere at the proximal end of the expiratory tube.

One problem that exists when performing anesthesia procedures on animal patients, is that animal patients often need to have their breathing assisted. Such assistance is performed by ventilating the animal patient. Ventilation typically occurs by collecting a reservoir of gas in a breathing bag or ventilation bag, (which is also known as an "ambu bag" or "vent bag"). The breathing bag is coupled to the proximal end of the expiratory circuit, and fills with expired gas, as well as gas from the gas source. To ventilate the patient, the gas filled ventilation bag can be squeezed. When the ventilation bag is squeezed, gas is forced from the vent bag, and flows "backwards" (in an inspiratory direction toward the distal, patient end) through the expiratory tube, and ultimately, into the tracheal tube or mask that is coupled to the animal. In a surgical procedure, the vent bag will typically be squeezed to ventilate the patient once every two or three minutes.

To couple the vent bag to the breathing system, a pair of expiratory tubes are employed, including a first expiratory tube and a second expiratory tube. A valve member is coupled between the first and second expiratory tubes. The first expiratory tube extends between the patient (distal) end fitting and the valve. The second expiratory tube extends between a distal end coupled to the valve, and a proximal end that is usually vented to atmosphere.

The valve includes a first port for receiving the proximal end of the first expiratory tube, and a second port for receiving the upstream (distal) end of the second expiratory tube. The valve will also usually include a third port for receiving the vent bag.

The fitting preferably contains a valve. The reason that the fitting contains a valve is to preclude air that is being squeezed from the vent bag from following the path of least resistance, as such path would cause the air to flow out the second expiratory tube into atmosphere rather than backwards through the first expiratory tube and into the animal patient.

Normally, in prior art devices, flow is generally unimpeded through the expiratory tubes, so that when the animal breathes out, the air flows through the first expiratory tube, into the fitting, and then freely flows out the second expiratory tube. The fitting often includes a valve that can block off the entrance (distal end) of the second expiratory tube, to keep air emerging from the vent bag from flowing out of the second expiratory tube. The valve is actuated into a closed position when one wishes to use the vent bag.

When one wishes to use the vent bag, one first closes off the valve, and leaves it closed. By closing off the entrance (upstream end) to the second expiratory tube, gas is permitted to flow into the vent bag and thereby inflate the vent bag. Once the vent bag is inflated, the vent bag can be squeezed, thus forcing the air backward through the fitting and through the first expiratory tube toward the distal (patient) end of the expiratory tube, and ultimately through the tracheal tube and into the lungs of the animal, which causes the animal to be ventilated with air.

Although the above system does perform its intended function, room for improvement exists. In particular, room for improvement exists with respect to the operation of the valve and the fitting.

One problem with the valve and the fitting, is that currently known valves and fittings typically have an "on" position and an "off" position, and can rest in and remain statically positioned in each of the "on" and "off" positions. As such, when the user goes to actuate the valve, in anticipation of using the vent bag, the user will normally move a slide switch from its off position to its on position (or actually from its open to its closed position) to close off the entrance to the second expiratory tube.

After the vent bag has been squeezed to ventilate the patient, the user is then supposed to move the valve back to its open position. Unfortunately, during the passage of time during procedures, users often forget to move the valve back into the open position.

The failure to move the valve back into the open position can have deleterious effects on the animal. When the valve is in the "closed position", expiratory gas cannot escape to atmosphere by traveling out the second expiratory tube. The constant and continual breathing of the animal, when coupled with the constant inflow of gas from the gas source, thereby causes the vent bag to inflate and fill. It is believed that within two to three minutes (at pressures and flow rates associated with most surgeries), the vent bag will be filled to a point, where the pressure exerted by the vent bag is sufficient to cause significant resistance to the further flow of air from the patient, to the vent bag. This excess pressure creates a back pressure on the animal's lungs that may be sufficient to keep the animal from breathing, because it cannot breathe and exhale gas, against the stored up pressure in the vent bag.

Another problem that exists with conventional fittings is that many require that the valve be closed for a certain period of time, in order to inflate the vent bag. Under normal conditions, with the valve in the open position, the flow of gas from the first inspiratory tube, through the fitting, and into the second expiratory tube is sufficiently favored (vis-a-vis flow into the vent bag), to prevent a significant amount of gas from accumulating in the vent bag. As such, when the user wishes to use the vent bag to vent the patient, he must shut the valve off and wait for a certain period of time for the vent bag to inflate, since closure of the valve is required to make the vent bag the preferred place for exhaled gas from the first expiratory valve to flow. Only after the vent bag is inflated, can the user squeeze the vent bag to thereby drive gas in a backward direction in the expiratory tube, and into the animal patient.

One object of the present invention is to provide a device that overcomes these deficiencies.

IV. SUMMARY OF THE INVENTION

In accordance with the present invention, a valve is provided for controlling the flow of gas through an anesthesia or breathing circuit. The valve comprises a valve body having a first port, a second port, and a third port. The third port includes a flow restrictor for restricting the flow of gas through the third port. A valve closing member is provided that is moveable between an open position where gas can flow through the third port, and a closed position. In the closed position, gas is prevented from flowing through the third port.

In a preferred embodiment of the present invention, the flow restrictor can include a plurality of apertures having a collective area smaller than the collective area of the third port. The plurality of apertures are preferably sized to permit gas to flow, under normal conditions, when the valve is open, from the first port into each of the second and third ports. The collective area of the plurality of apertures should be sized to be large enough, when the valve is in the open position, to prevent air in the breathing bag from exerting enough back pressure through the first port to impede breathing of a patient coupled to the first port and valve.

The valve closing member can include a closing member that is moveable between a closed position, wherein the closing member covers the plurality of apertures, and an open position wherein the closing member uncovers the apertures to permit gas to flow there through. A biasing means such as a spring is provided for normally biasing the closure member into an open position, to permit gas to flow through the second port.

The valve of the present invention is designed to normally be used in connection with a breathing and respiratory circuit. In such a breathing or respiratory circuit, the first port of the valve is coupled to an expiratory tube that includes a proximal end that is coupled to a patient, and a distal end that is coupled to the first port of the valve. The proximal end of the expiratory tube can be coupled to the patient by either a face mask or a tracheal tube. The first expiratory tube conducts gas expired by the patient into the valve. The second port of the valve is preferably coupled to an elastic-type breathing bag, of the type normally used to help ventilate a patient. The third port of the valve is couples to a second expiratory tube, that is provided for conducting expiratory gas either to the atmosphere, or to an exhaust device, if it is desired to exhaust the patient's gas to somewhere outside of the operating area.

V. BRIEF DESCRIPTION OF THE DRAWINGS

Figure 4:
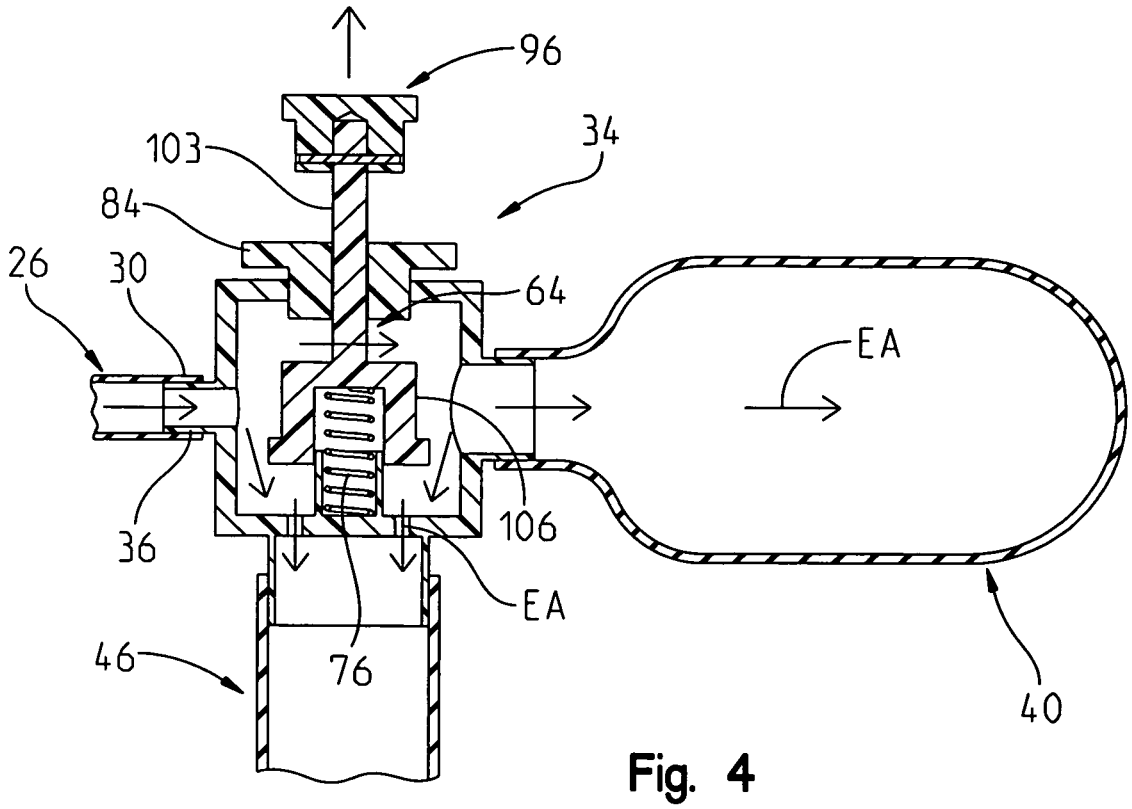
Figure 5:
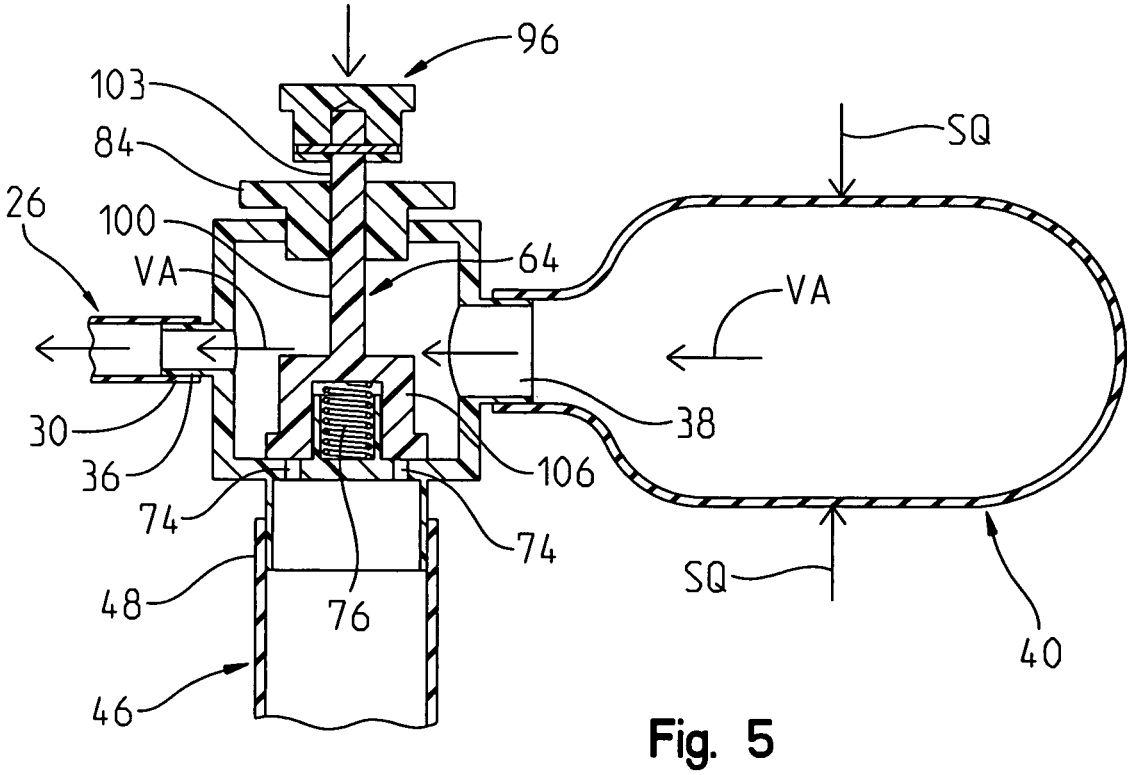

FIG. 4 is a side view of the valve 34 of the present invention in the open position wherein expiratory gas EA can flow through the valve 34 and into both the bag 40 and the second expiratory tube; and FIG. 5 is a side view if the valve 34 of the present invention in the closed position wherein vent gas is forced back through first expiratory tube 26, and is not permitted to flow into second expiratory tube 50.

VI. DETAILED DESCRIPTION OF PREFERRED EMBODIMENTS

Figure 1:
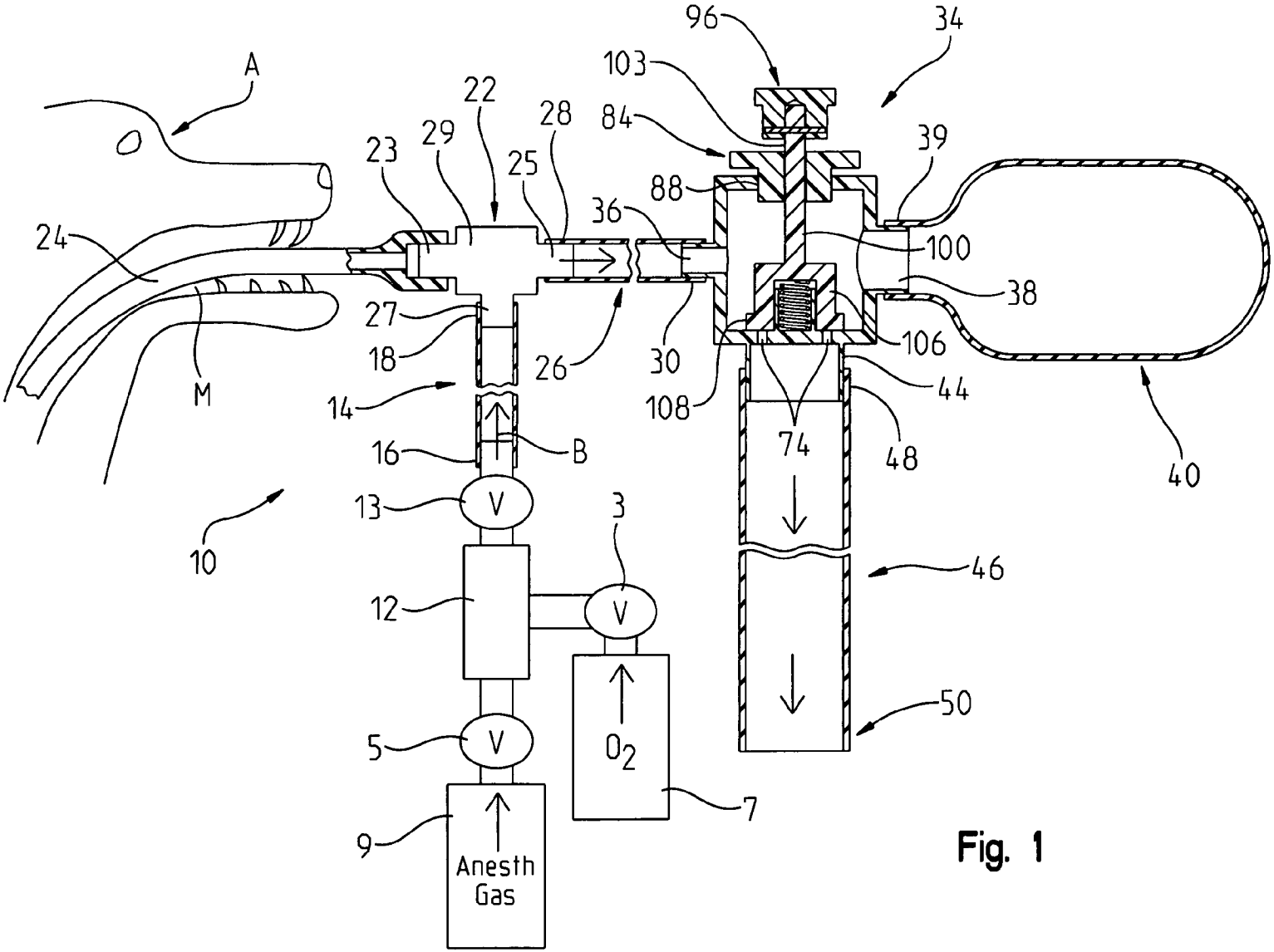
FIG. 1 is a schematic view of an anesthesia circuit incorporating the fitting and valve of the present invention.
Figure 2:
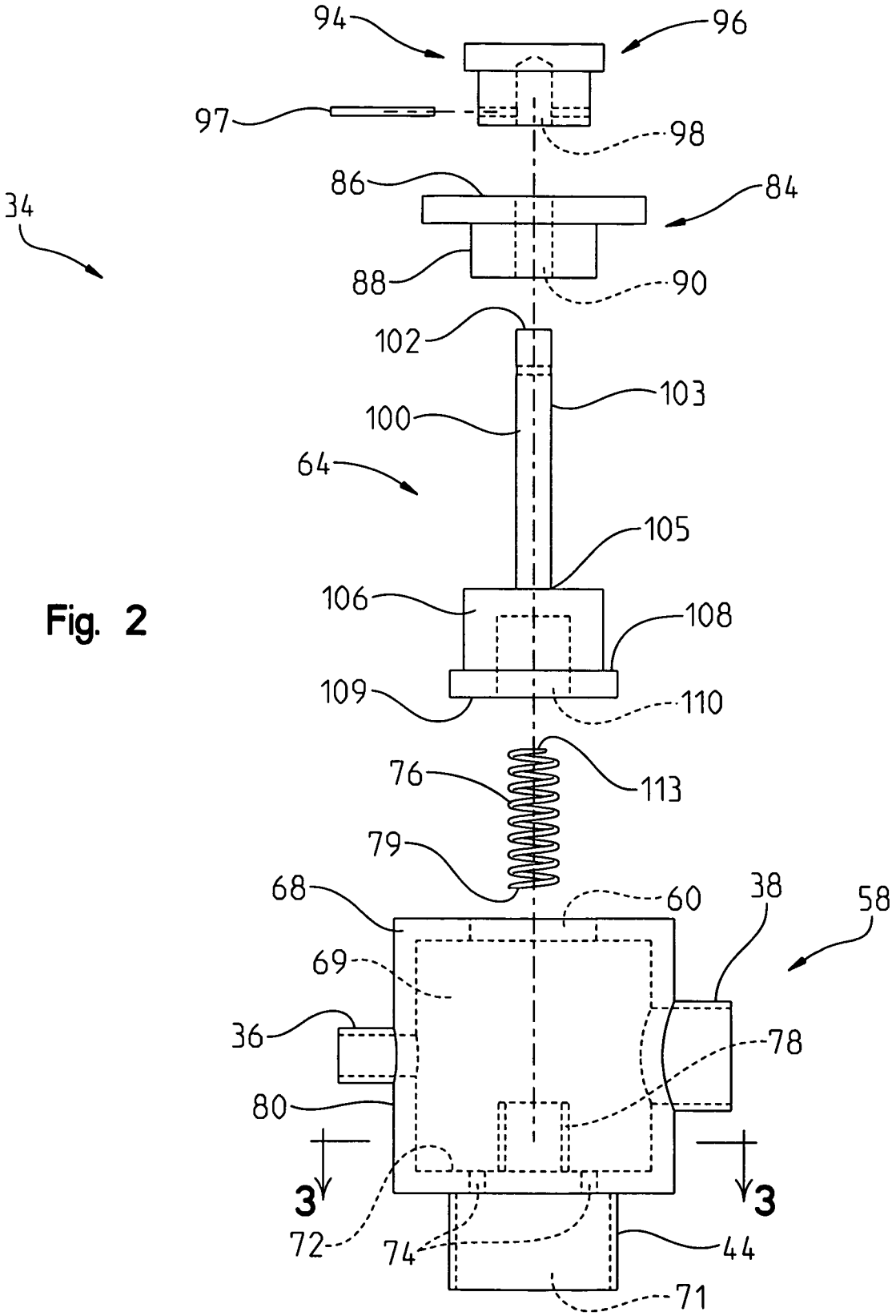
FIG. 2 is an exploded view of the valve of the present invention.

Turning now to FIG. 1, an anesthesia system breathing circuit 10 is shown that is used in connection with an animal A. Those familiar with breathing circuits will recognize that the breathing circuit 10 has some similarities to a Mapleson type of breathing circuit.

The breathing circuit 10 is coupled to a gas source 12. Preferably, the gas source includes both a source of anesthesia gas 9, along with a source of oxygen 7. In such a Mapleson type circuit, the patient is usually fed a gas and oxygen mixture. Valves 3,5 are positioned for controlling the flow of oxygen and gas into the source 12. A valve 13 is coupled to the gas source 12 to control the flow of gas from the gas source 12 to an inspiratory tube 14. As used herein, the term "gas" will refer generally to an appropriate mixture of anesthesia gas, air, and/or oxygen (and possibly other gases), it being appreciated the percentage mixture of materials is subject to wide variation, depending upon the procedure, the circumstances and other factors. The inspiratory tube 14 includes an upstream (proximal) end 16 coupled to the downstream side of valve 13 of the gas source 12, and a downstream (distal) end 18 that is coupled to a fitting 22 to fixedly couple the inspiratory tube to the interior air space of the fitting 22. Gas within the inspiratory tube 14 generally flows in a one-way direction from the upstream end or gas source 12, through the valve, toward the downstream end 18 of the fitting, in a direction generally indicated by the arrows B contained within the inspiratory tube 14.

The fitting 22 has a first (patient) port 23, and a second inspiratory tube port 25. The first port 23 of the fitting 22 is coupled to a patient gas delivery device 24, such as a tracheal tube 24, or a face mask type device (not shown). The second port 25 of the fitting 22 is coupled to the upstream (distal) end 28 of the first expiratory tube 26. Fitting 22 is preferably made from a transparent plastic material (e.g. polycarbonate), and can be formed as an end of the expiratory tube 26. However, due to the presence of the third fitting 27, for gripping the inspiratory tube 14, it is best to usually form the fitting 22 as a separate part that may or may not be bonded to the expiratory tube 26.

The tracheal tube 24 is preferably inserted in the mouth and down the windpipe of the animal A. Preferably, the distal end of the tracheal tube 24 extends through the trachea, through the larynx of the animal, and stops short of the point wherein the trachea bifurcates into the first and second bronchi, which go to the respective right and left lungs.

The expiratory tube 26 preferably comprises a corrugated-type tubing, and includes an upstream (distal) end 28, coupled to the fitting 22 and a downstream (proximal) end 30 that is coupled to a first port 36 of the valved fitting 34. The first expiratory tube 26 can be of conventional construction and acceptable expiratory tubes 26 are available from a wide variety of sources.

Valve fitting 34 includes a first port 36 that is coupled to the downstream (proximal) end of the first expiratory tube 26; a second port 38 that is coupled to the mouth-like opening 39 of the vent bag 40; and a third port 44. Third port 44 is coupled to the upstream (distal) end 48, of second expiratory tube 46. The second expiratory tube 46 also includes a downstream end 50.

The tracheal tube 24, gas source 12, valve 13, inspiratory tube 14, fitting 22 and first and second expiratory tubes 26, 46, along with vent bag 40, are generally known in the prior art.

However, the inventive valved fitting 34 of the present invention is not known in the prior art.

The novel and inventive valved fitting 34 of the present invention is best shown in FIGS. 2-5. The valved fitting 34 includes a generally plastic housing member 58. Housing member 58 includes a first port 36, that is mateable to the downstream (proximal) end 30 of the first expiratory tube 26; a second port 38, that is mateable to the mouth 39 of the breathing bag 40, and a third port 44, that is mateable to the upstream (distal) end 48 of the second expiratory tube 46. The housing 58 also includes a top, valve receiving opening 60 for receiving various valve components, and in particular, the valve member 64.

Figure 3:
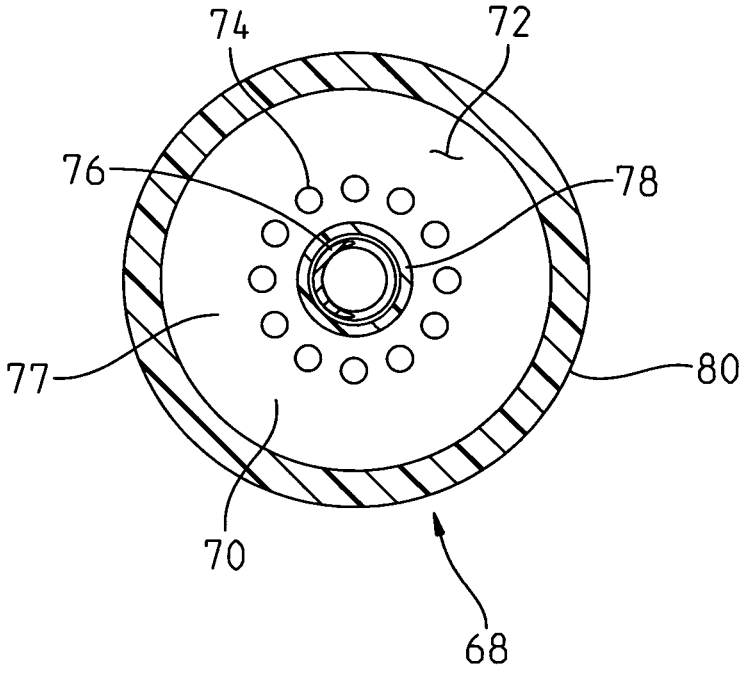
FIG. 3 is a sectional view taken along lines 3-3 of FIG. 2.

The valve member 64 selectively engages valve opening 68, that is formed as a part of housing 58, and is disposed between the interior 69 of the valved fitting 34, and the interior 71 of the third port 44. The valve opening 68 is best shown in FIG. 3, as including a relatively radially inwardly disposed aperture containing base portion 70, and a relatively radially outwardly disposed valve seat portion 72. The aperture 74 containing base portion 70 is generally planar, extends in a radial direction, and includes a circular array of apertures 74, that are arrayed around a central, axially extending spring retaining tube 78. Spring retaining tube 78 is provided for receiving a coil spring 76, and for serving as the downstream seat for the spring 76.

The circular array of apertures 74 are chosen in number, and aggregate area to serve as a flow restrictor for restricting flow through the third port by providing a limited resistance to the flow of gas through the apertures 74. When deciding how to properly size the apertures, one does not want the apertures to be sized too large. If the apertures are sized too large (in aggregate area), almost all of the expiratory gas that is expired by the patient animal A, will flow through the apertures 74 in an unimpeded manner and will flow out the second expiratory tube 46. This relatively high flow rate of gas through the apertures 74 and out the expiratory tube 46, will prevent the vent bag 40 from inflating under normal circumstances when the valve 64 is in the open position.

On the other hand, one does not wish to size the aggregate size of the apertures 74 too small, for sizing the apertures 74 to small creates too much resistance to flow there through. If the apertures 74 are too small, an insufficient amount of expiratory gas will flow through the apertures 74 and out of the expiratory tube 46. This will cause the vent bag 40 to inflate to a point where the gas within the vent bag 40 is sufficiently pressurized to exert a backwardly directed pressure through the expiratory tube 26, that makes it more difficult for the animal to breathe out expired gas, and which, if great enough can seriously impeded the animal's ability to exhale.

In this regard, the Applicant has found that an optimal array of circular apertures is achieved by using eight (8) apertures, each of which is about 0.059 inches in diameter.

Although apertures of different sizes and different amounts can be used, the foregoing example is illustrative of a set of apertures 74 that strike a functionally desirable balance, when the valve 64 is in the open position (FIG. 4), between allowing sufficient flow of expiratory gas EA (FIG. 4) there through 74 to prevent unwanted back pressure, while being small enough so as to enable a portion of the expiratory gas EA to flow into bag 40, to cause the vent bag 40 to inflate during normal use of the valves.

The valve 64 is normally biased in the open position (FIG. 4) rather than the closed position (FIG. 5) because it is desirable to have the vent bag 40 inflate during normal use of the circuit. Having the vent bag 40 in a normally inflated configuration is desirable so that when one wishes to ventilate the animal patient by squeezing the vent bag 40, one does not have to wait for the vent bag 40 to inflate. Rather, the vent bag 40 should already be inflated, thereby enabling the user to close the valve 64 to prevent flow, and squeeze the vent bag immediately.

The tube 78 that serves as a seat for a spring 76 should generally be sized to have a sufficient height to securely retain the second end 79 portion of the spring 76, and should also have a sufficient internal diameter, to receive the spring internally within the hollow interior of tube 78. Preferably, the spring 76 has a size, shape and spring resistance factor that is somewhat similar to but stronger than the spring that one might find in a retractable ballpoint pen, to offer a little more resistance to compression than would a ball point pen spring. The spring 76 should be designed to normally urge the valve member 64 upwardly, into the valve opened position (FIG. 4) so that the apertures 74 are normally open, except at those times when the valve 64 is actuated to close the apertures 74 (FIG. 5). As such, the open position of the valve and apertures is the "default" position of the valve 64.

The valve fitting 64 includes a plurality of associated components, including a plug member 84, a top cap 94, a valve stem 100, and a closing member 106, that is formed as a part of the valve stem 100.

The plug member 84 serves as a plug for plugging top opening 60. The plug member 84 includes a radially extending plug portion 86 that has a diameter sufficient to engage the radially inwardly facing axially extending walls of the top aperture 60. Alternately, the radially extending portion 86 of the plug member 84 can be designed to overlay the top opening, or be designed to be threadedly engaged with walls of the top opening 60. In another variation the underside surface of the plug member 86 can be glued or sonically bonded to the axially outwardly facing top lip of the top opening 60.

An axially extending central aperture 90, extends axially through the plug member 84, to permit the upper end 102 of the valve stem 108 to be received within the aperture 90. The plug member 84 also includes a relatively reduced diameter plunger receiving portion 88 that includes the central aperture 90, for receiving the plunger/valve stem 100.

A top cap member 94 is disposed exteriorly of the valve fitting 34, and includes a radially extending button portion 96 having an upper surface 93 for receiving the finger of the user, that is received thereon to actuate the valve 64 between its open and closed position. The top cap member 94 also includes a reduced diameter axially inwardly disposed portion 97 that includes a blind aperture 98. The blind aperture 98 is sized and positioned for receiving the upper end 102 of the valve stem 100 that, as discussed above, extends through the central aperture 90 of the plug 84. Blind aperture 98 is preferably aligned with aperture 90, so that the upper end 102 of the valve stem 100 can extend through both apertures 90, 98.

The valve stem 100 includes a shaft-like valve stem portion 103, having an upper end 102, and a relatively lower end 105. The lower end 105 of the valve stem 100 terminates in a relatively enlarged diameter closing member 106. Closing member 106 includes, at its distal end, a radially extending, relatively larger diameter valve seat engaging member 108.

The lower surface 109 of the valve seat engaging member 108 is provided for engaging the valve seat 72 portion of the upper surface of the base 70, for covering the apertures 74, to thereby close the valve of the valve fitting 34, to thereby prevent gas from flowing through the valve fitting out into second expiratory tube 46.

The closing member 106 also includes a blind aperture 110 formed in the valve seat opening surface 108. Blind aperture 110 is sized and positioned for receiving the proximal end 113 of the spring 76, and for also interiorly receiving the spring aligning tube 78. This reception of the spring aligning tube 78 in the blind aperture 110 helps to maintain the alignment between the valve stem 100, and the valve seat 72.

The device operates as follows. The anesthesia circuit 10 is hooked up to the animal A, in a manner similar to that shown in FIG. 1. The valves 5,3 that control the flow of anesthesia gas and oxygen to the gas source 12, and ultimately to the circuit 10 are opened to ensure a proper mixture and flow rate of the gases. The valve 13 is then turned on to allow the gas source 12 to cause the mixed gases to flow through the inspiratory tube 14, and into the tracheal tube 24, and thereby into the lungs of the animal patient A.

When the animal A exhales, its exhaled breath goes through the first expiratory tube 26. When this occurs, the valve fitting 34 normally has the valve 64 in the open position, such that the closing member 108 does not cover the apertures 74, so that gas EA can flow through the apertures 74 and into the second expiratory tube 46 as shown in FIG. 4. As the animal A continues to breathe, most of the expiratory EA gas will flow through the expiratory tube 26, into the interior 69 of the fitting, through the aperture 74, and into the interior 71 of the third port 44, and ultimately into the second expiratory tube 46. The gas will then flow to the distal end of the second expiratory tube 46, where it will usually be vented to atmosphere, or possibly to some gas trap or exhaust fan if the practitioner desires to keep oxygen and anesthetic gases out of the operating theater.

Because of the flow resistance provided by the apertures 74, not all of the gas will flow through the apertures 74. Rather, some gas will flow into the interior of the vent bag 40, to cause the vent bag 40 to partially inflate to a fully inflated, but not highly pressurized condition. To understand this, one should imagine a balloon or a tire, that has sufficient air within it to inflate it to its full shape, but that is not inflated to a highly pressurized condition. In this particular inflated but not pressurized condition, the vent bag 40 and the gas therein does not exert significant back pressure against the expiratory tube 26 since any such pressure build up in the bag 40 will be vented through the open aperture of the second expiratory tube, thereby allowing the animal A to breathe freely and exhale through the expiratory tube.

Approximately every two to three minutes it may be necessary to ventilate the patient/animal A. When this occurs, the user engages his finger onto the upper surface of the button portion 96 of the cap 94. The user then presses downwardly on the button-like 96 to move the closing portion 108 into engagement with the valve seat 72, to thereby cover and seal off the aperture 5 in the aperture opening 74. When the apertures 74 are sealed off, as shown in FIG. 5, the user can then squeeze the vent bag 40 in a direction shown by arrows SQ, to force air VA within the vent bag 40 backwardly through the expiratory tube 26, as shown by arrows VA, and into the tracheal tube 24 and ultimately into the lungs of the animal patient A.

If the valve apertures 74 were not blocked when the vent bag 40 was squeezed, the air in the vent bag 40 would likely follow the path of least resistance. This path of least resistance would cause a significant portion of the gas in the vent bag 40 to flow through the apertures 74, and out the second expiratory tube 46, and ultimately to atmosphere. However, when the valve 64 is closed by depressing the button 94 to close off apertures 74, the path of least resistance then becomes the path wherein the gas flows backwardly through the expiratory tube 26 and into the patient animal A as indicated by arrows VA of FIG. 5.

After the vent bag 40 has been squeezed and the patient animal A ventilated through what is usually a single squeeze of the bag 40, the user removes his finger from the valve fitting button 94. The spring 76 biases the valve member 64 axially outwardly, to cause the stem 103 to move upwardly, to thereby cause the closing member 108 to move out of engagement with the apertures 74. This opens the apertures 74, that allows subsequent expired Gas GA from the animal IA to flow through the aperture 74 and out the second expiratory tube 96.

Having described the invention in respect to certain details, it will be appreciated that the invention is not limited by the preferred embodiment described herein, but extends to equivalents and other embodiments limited only by the appended claims.

What is claimed:

1. A valved fitting for controlling the flow of gas through a non-rebreathing type anesthetic or non-rebreathing type respiratory breathing circuit including a patient gas delivery device for delivering gas to a patient, a gas source for supplying a gas for delivery to the patient gas delivery device, a gas source tube and fitting in gaseous communication with the gas source and positioned in the breathing circuit between the patient delivery device and the valved fitting, a first expiratory tube for conducting expired gas from the patient to the valved fitting, the expiratory tube being positioned in the breathing circuit between the patient delivery device and the valved fitting; a breathing bag actuable to force gas through the first expiratory tube and the patient delivery device and to the patient, and a second expiratory tube for conducting expired gas away from the valved fitting, the valved fitting comprising:

a valve body having an interior, a first port for fluidly coupling the first expiratory tube to the interior of the valve body, a second port for fluidly coupling the breathing bag to the interior of the valve body, and a third port for fluidly coupling the second expiratory tube to the interior of the valve body; and a user actuable valve closing member being movable between an open position where gas can flow through the third port and a closed position where gas is prevented from flowing through the third port, the valve closing member being biased to normally be in the open position and being movable into the closed position when the breathing bag is being actuated to force gas to the patient delivery device to prevent gas from the breathing bag from flowing into the second expiratory tube, and wherein a flow of gas being expelled from the breathing bag is confined in the breathing circuit to the breathing bag, valve body interior, patient delivery device, gas source tube and fitting and first expiratory tube for better directing the expelled gas to the patient.

2. The valved fitting of claim 1 wherein the flow restrictor includes a plurality of apertures having a collective area smaller than the collective area of the third port.

3. The valved fitting of claim 2 wherein the collective area of the plurality of apertures is sized to permit gas to flow, under normal conditions, from the first port and into each of the second and third ports when the valve closing member is in the open position.

4. The valved fitting of claim 3 wherein the collective area of the plurality of apertures is sized to be small enough to permit gas to flow, under normal conditions, through the second port in sufficient quantity to cause the breathing bag to be in an inflated condition.

5. The valved fitting of claim 3 wherein the collective area of the plurality of apertures is sized to be large enough, when the valve is in the open position, to prevent the gas in the breathing bag from exerting enough pressure through the first port to impede breathing of a patient coupled to the first port and valve.

6. The valved fitting of claim 5 wherein the valve closing member includes a closing member moveable between a closed position where the closing member covers the plurality of apertures, and an open position wherein the closing member uncovers the apertures to permit gas to flow there through.

7. The valved fitting of claim 6 further comprising a biasing member for normally biasing the closing member into the open position to permit gas to flow through the second port.

8. The valved fitting of claim 1 wherein the first expiratory tube includes a proximal end coupled to the patient gas delivery device and a distal end coupled to the first port, and the second expiratory tube includes a proximal end coupled to the third port and a distal end in communication with at least one of atmospheric pressure and sub-atmospheric pressure.

9. The invention of claim 1 wherein the flow restrictor restricts the flow of gas through the third port to permit gas to flow, under normal conditions through the second port when the valve closing member is open in sufficient quantity to cause the breathing bag to be in an inflated condition.

10. The valved fitting of claim 9 wherein the flow restrictor permits gas to flow through the third port, under normal conditions when the valve closing member is open, to permit a sufficient quantity of gas to flow through the third port to prevent the breathing bag from exerting a breath impeding back pressure on the patient.

11. The valved fitting of claim 1 wherein the valve closing member includes a cover member moveable between a closed position wherein the cover member covers the third port to prevent the flow of gas into the third port, and an open position wherein the cover member uncovers the third port to permit gas to flow through the port.

12. The valved fitting of claim 11 further comprising a biasing member for normally biasing the cover member into the open position.

13. The valved fitting of claim 1 further comprising a biasing member coupled to the valve closing member for normally biasing the valve closing member in the open position.

14. The valved fitting valve of claim 1 wherein the third port includes a valve seat engageable with the valve closing member and the valve seat includes an array of apertures positioned to be selectively covered by the valve closing member.

15. The valved fitting of claim 14 wherein the array of apertures comprises a circular array of apertures sized to provide resistance to flow of gas there through.

16. The valved fitting of claim 15 wherein the apertures each have a diameter of less than about 0.1 inches.

17. The valved fitting of claim 1 wherein the valve closing member includes a biasing member to normally bias the valve closing member into the open position to permit gas to flow through the third port, and a user engageable actuator for permitting the user to move the valve closing member into the closed position to prevent gas from flowing through the third port.

18. A non-rebreathing breathing circuit for administering at least one of respiratory and anesthetic gases to a patient comprising:

a patient gas delivery device for delivering a gas to a patient a first expiratory tube having a proximal end capable of being fluidly coupled to the patient gas delivery device for receiving gases from and delivering gases to the patient; and a distal end;

a gas source tube and fitting in gaseous communication with the patient gas delivery device and first expiratory tube and being positioned in the breathing circuit between the patient gas delivery device and the first expiratory tube a second expiratory tube having a proximal end and a distal end;

a flexible breathing bag having a hollow interior and a breathing bag port for permitting gas to flow into and out of the hollow interior, the breathing bag being capable of being compressed to cause gas to be expelled under pressure from the breathing bag interior and into at least one of the first expiratory tube and patient; and a valve for controlling the flow of gas through the breathing circuit, the valve comprising:

a valve body having an interior space;

a first port coupled to the distal end of the first expiratory tube for placing the first expiratory tube in fluid communication with the interior space of the valve body;

a second port coupled to the breathing bag port for placing the interior of the breathing bag in fluid communication with the interior space of the valve body;

and a third port coupled to the proximal end of the second expiratory tube for placing the second expiratory tube in fluid communication with the interior space of the valve body; and a valve closing member normally biased in an open position and being moveable between the open position wherein gas can flow through the third port, and a closed position wherein gas is prevented from flowing through the third port, wherein, when in the closed position, a flow of gas being expelled from the breathing bag is confined in the breathing circuit to the breathing bag, valve body interior space, first expiratory tube, gas source tube and fitting and patient delivery device for better directing the flow of expelled gas to the patient.

19. The breathing circuit of claim 18 wherein the third port includes a flow restrictor for restricting the flow of gas through the third port, the flow restrictor restricting the flow of gas in the third port when the closing member is in the open position sufficiently to permit the interior of the breathing bag coupled to the second port to retain and hold sufficient gas to cause the breathing bag to inflate.

20. A valved fitting for controlling the flow of gas through a non-rebreathing anesthetic or a non-rebreathing respiratory breathing circuit including a patient gas delivery device for delivering gas to a patient, a gas source for supplying a gas for delivery to the patient gas delivery device, a gas source tube and fitting in gaseous communication with the gas source and positioned in the breathing circuit between the patient delivery device and the valved fitting a first expiratory tube for conducting expired gas from the patient to the valved fitting, the expiratory tube being positioned in the breathing circuit between the patient delivery device and the valved fitting, a breathing bag fluidly coupled to the valved fitting and actuable to force gas to the patient delivery device, and a second expiratory tube for conducting expired gas away from the valved fitting, the second expiratory tube having a proximal end coupled to the valved fitting and a distal end fluidly coupled to a space exterior of the breathing circuit, the valved fitting comprising:

a valve body having an interior, a first port for fluidly coupling the first expiratory tube to the interior of the valve body, a second port for fluidly coupling the breathing bag to the interior of the valve body, and a third port for fluidly coupling the second expiratory tube to the interior of the valve body, the third port including a flow restrictor for restricting the flow of gas through the third port; and a user actuable valve closing member being movable between an open position where gas can flow from the first expiratory tube and breathing bag and out through the third port and second inspiratory tube to the space exterior of the breathing circuit; and a closed position where gas expelled from the breathing hag is prevented from flowing from the breathing bag, through the third port, and to the space exterior of the breathing circuit, the valve closing member being biased to normally be in the open position and being movable into the closed position when the breathing bag is being actuated to force gas to the patient delivery device wherein, when in the closed position, a flow of gas being expelled from the breathing bag is confined in the breathing circuit to the breathing bag, valve body interior space, first expiratory tube, gas source tube and fitting and patient delivery device for better directing the flow of expelled gas to the patient.

* * * * *